340-552 SR
10/11/83 XR 4,409,590

United States Patent [19]
Baker

[11] 4,409,590
[45] Oct. 11, 1983

[54] BUILDING SECURITY, COMMUNICATION AND CONTROL SYSTEM

[75] Inventor: Lewin T. Baker, Schenectady, N.Y.

[73] Assignee: General Electric Company, Schenectady, N.Y.

[21] Appl. No.: 305,867

[22] Filed: Sep. 28, 1981

[51] Int. Cl.³ ..... G08B 1/08
[52] U.S. Cl. ..... 340/533; 340/552; 340/538; 340/825.37; 455/41
[58] Field of Search ..... 340/531, 533, 538, 825.37, 340/552, 553; 455/41

[56] References Cited

U.S. PATENT DOCUMENTS

| | | | |
|---|---|---|---|
| 355,470 | 1/1887 | Phelps | 455/41 X |
| 2,064,994 | 12/1936 | Stirlen . | |
| 2,355,395 | 8/1944 | Rubenstein . | |
| 2,853,557 | 9/1958 | Lehman . | |
| 3,076,058 | 1/1963 | Miller . | |
| 3,149,320 | 9/1964 | Devine | 340/533 |
| 3,384,887 | 5/1968 | Trimble . | |
| 3,439,357 | 5/1969 | DeGibaja . | |
| 3,445,835 | 5/1969 | Fudaley . | |
| 3,573,783 | 4/1971 | Fudaley . | |
| 3,757,323 | 9/1973 | Pintell | 340/533 X |
| 3,794,992 | 2/1974 | Gehman | 340/552 X |
| 3,803,491 | 4/1974 | Osborn . | |
| 4,091,367 | 5/1978 | Harman | 340/552 |
| 4,123,748 | 10/1978 | Otani | 340/538 X |
| 4,136,338 | 1/1979 | Antenore | 340/551 |
| 4,148,019 | 4/1979 | Durkee | 340/531 |
| 4,174,518 | 11/1979 | Mongeon | 340/561 |

*Primary Examiner*—David L. Trafton
*Attorney, Agent, or Firm*—Geoffrey H. Krauss; James C. Davis, Jr.; Marvin Snyder

[57] ABSTRACT

A system for providing perimeter security, intra-building communication and control functions, utilizes a pair of single wire loops placed about the periphery of the building, and spaced from one another. At least one facilities unit, for fire detection, appliance control and the like functions, has the powering battery thereof series-connected in one of the perimeter loops, and with that loop being connected to battery trickle-charging circuitry. Each of the unit batteries is bypassed by a capacitive element, selected for the frequency, partly determined by the capacitance between the pair of loops, of an oscillator for detecting proximity of intruders adjacent to the building periphery. The proximity-detection oscillator includes a transformer for coupling a data transceiver to and from the remaining loop, whereby voice and/or digital communications may be modulated upon a magnetic field extending throughout the interior of the building for communications to and from independent units therein.

10 Claims, 2 Drawing Figures

BUILDING SECURITY, COMMUNICATION AND CONTROL SYSTEM

BACKGROUND OF THE INVENTION

The present application is directed towards multi-function intra-building communication systems and, more particularly, to a novel system for providing simultaneous security, communication and control functions within the periphery of a building.

Intra-building communication is often required to not only provide building security, by monitoring the periphery of the building for intruders, but also to inactivate, set, reset and monitor detection devices, such as smoke, gas and open-door/open-window detectors. Additional intra-building communications for the monitoring and control of lights and appliances, both to control power usage and the technical functions, is also highly desirable. Because such intra-building communications are desirably provided without causing interference to other electronic devices in th building, or in adjacent buildings, previous approaches to this problem, such as the addition of signal wires to the structure, use of power wiring for communications and radio transmission, have all been found to be somewhat less than optimum, due to respective problems in the difficulty and expense of adding additional wires to a building interior after the building has been constructed, the presence of power line interference, harmonics and transients when power line carrier communication is attempted, and radio transmission interference from signals originating at relatively large distances from the building to be monitored. It is known that magnetic induction, by means of a loop of wire formed about the building periphery, has potential for providing intra-building communication.

BRIEF SUMMARY OF THE INVENTION

In accordance with the invention, a system for providing security, communication and control functions in a building, utilizes: a pair of spaced-apart conductive loops placed about the building periphery; and a central control unit including an oscillator having an inductance and oscillating at a frequency controlled by that inductance and the capacitance between the pair of building-periphery loops, and also having a data transceiver transformer coupled to one of the loops. A change in interloop capacitance changes the oscillator frequency, whereby the presence of possible intruders at the building periphery can be detected. The transceiver causes a magnetic field to be generated and substantially contained within the first loop area. The magnetic field can be received by an independent unit within the loop periphery. The transmitted data from the independent unit is received by the first loop and conducted to the transceiver, whereby remote units, within the building, can receive data from, and transmit data to, a central facility, with minimum interference from power lines, radio and television stations and the like potential interferring sources. At least one remote-sensing unit, of the fire detection, gas detection, smoke detection and the like types, has the power source thereof wired in series with the remaining loop, and suitably bypassed to provide essentially the same intrusion-oscillator-frequency potential about the second loop, whereby the second loop can be wired in series with means for charging the power sources of the remote sensing units wired in series with that loop. The remote units may further operate by inductive coupling to the first loop, for transmission of alarm data back to the central location within the building.

Accordingly, it is an object of the present invention to provide a novel security, communications and control system for use in a residence and the like building.

This and other objects of the present invention will become apparent upon consideration of the following detailed description, when read in conjunction with the drawings.

DETAILED DESCRIPTION OF THE INVENTION

Figure 1:
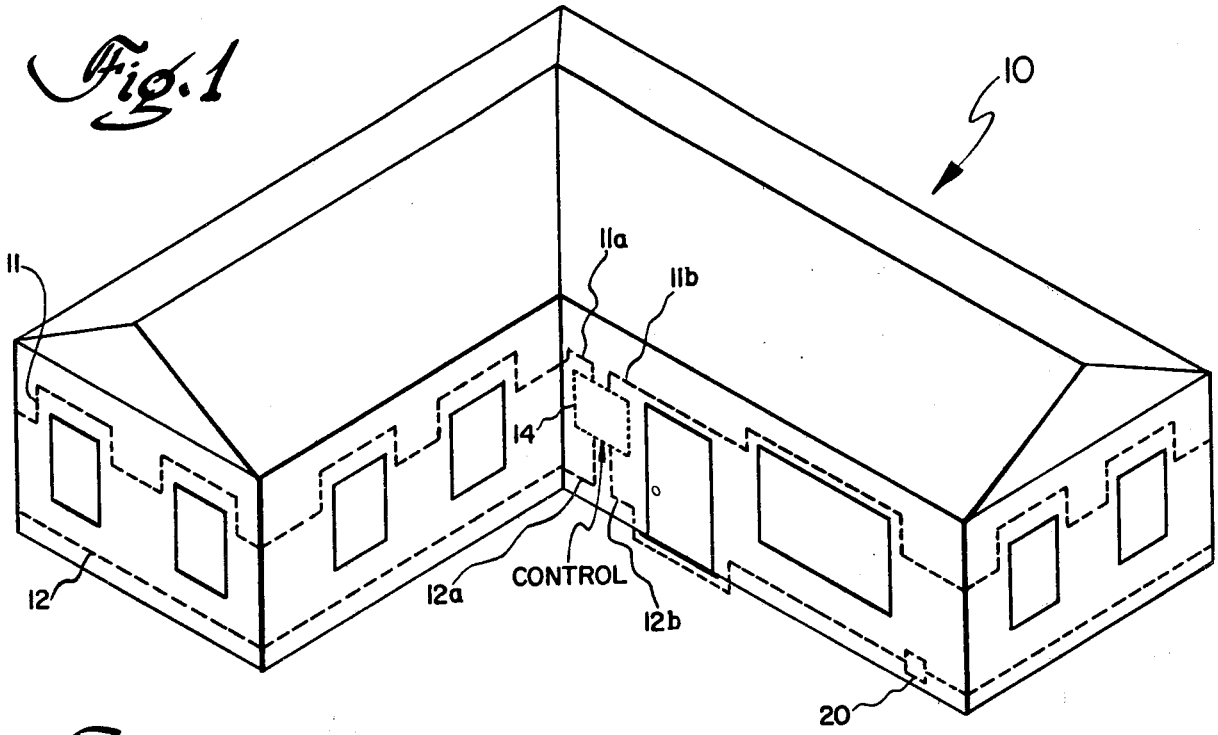
FIG. 1 is a perspective view of a building upon the walls of which are installed the magnetic-field coils of the present invention.
Figure 2:
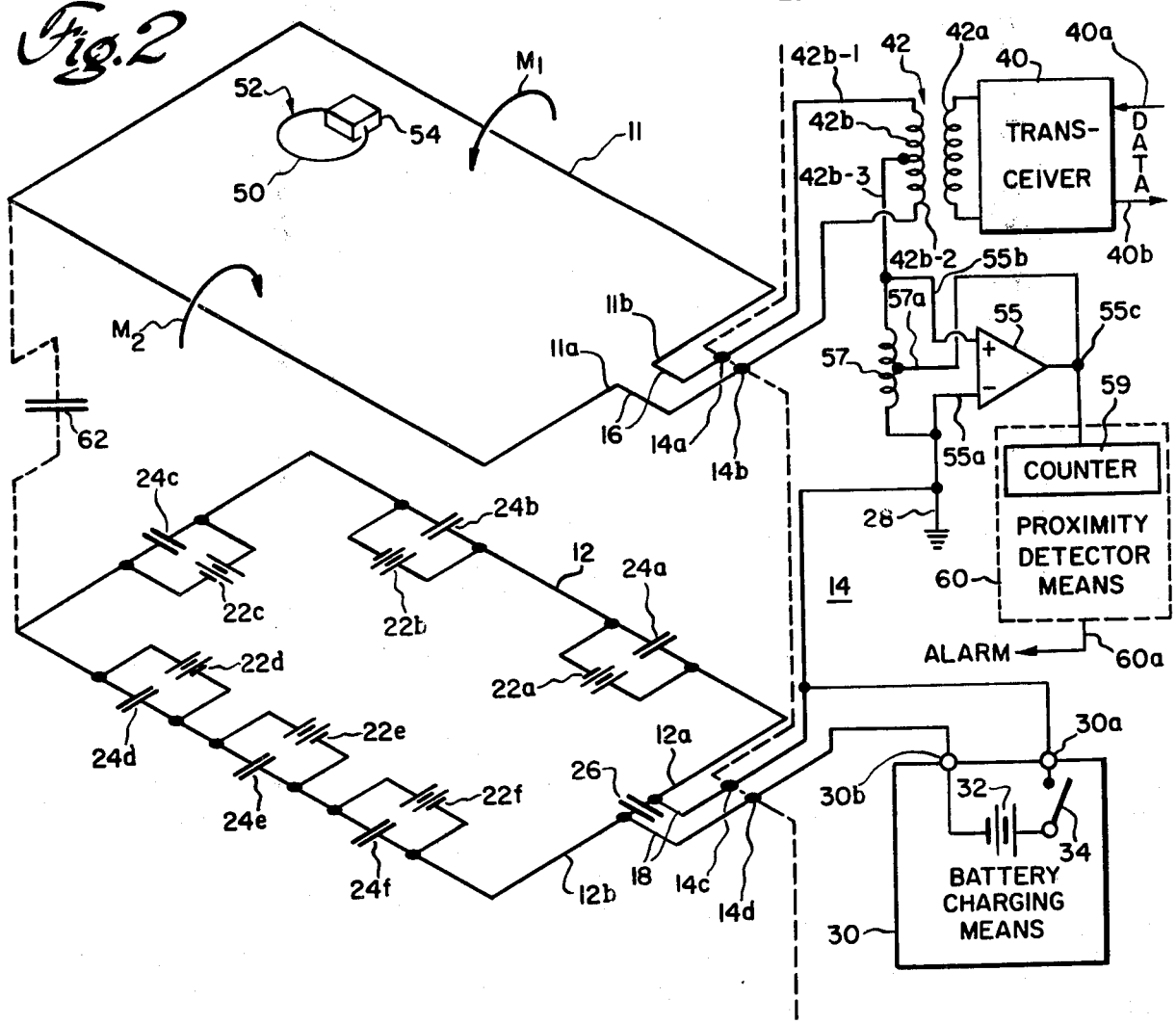
FIG. 2 is a schematic block diagram illustrating the principles of the present invention.

Referring to the Figures, a building 10, which may be a residence, small commercial building or the like, is to be provided with certain command, communication and control functions such that, without causing interference to appliances and other electronic devices within building 10, or in neighboring buildings, the security of the building may be increased, e.g. by proximity detection of intruders and the like, while data communications (of both digital and voice types) throughout the building are to be provided, in addition to providing replenishment of self-contained energy sources associated with control of appliances and other electrical/elctronic equipment within the building. building.

In accordance with one aspect of the invention, first and second conductive loops 11 and 12, of wire or the like material, are each positioned at a different height about the periphery of building 10. Thus, first conductive loop 11 is positioned towards the top of the building, starting at a first end 11*a*, adjacent to a control unit 14 location, and continuing around the building. Upper loop 11 has a remaining end 11*b* adjacent to first end 11*a* and connected to control apparatus 14. The second, lower loop 12 also has a first end 12*a* and a second end 12*b*, both positioned close to control unit 14. Advantageously, both loops 11 and 12 may be of relatively thin wire, attached directly to the exterior surface of building 10; to improve aesthetic qualities, the conductive wire may be covered with insulation of the same color as the building exterior, and one or both lopps may have portions thereof differing in horizontal level, as necessary to pass about the periphery of windows, doors and the like.

Control unit 14 includes a pair of input terminals 14*a* and 14*b* or 14*c* and 14*d*, associated with each of loops 11 and 12, respectively. As unit 14 may be installed other than adjacent to the building exterior surface, suitable leads, such as twisted-pair wires 16 and 18, may be utilized to connect upper loop control input terminals 14*a* and 14*b* respectively to upper loop first and second ends 11*a* and 11*b*, and lower loop input terminals 14*c* and 14*d*, respectively to lower loop ends 12*a* and 12*b*. At least one functional unit 20, such as a smoke detector/fire alarm unit, remote-control unit and the like, is located near, but not necessarily at, the building periphery. Each functional unit is advantageously battery operated, with the rechargeable battery 22 of each unit being connected in electrical series connection with the conductor of second loop 12, and suitably bypassed by a shunt capacitance element 24. Each capacitance 24 has a very low impedance at the data transceiver and proximity detector operational frequencies, whereby substantially all of second loop 12 is at the same A.C. potential at these frequencies. Thus, if a plurality, e.g. six, of functional units 20 are utilized in a particular building, the internal batteries 22*a*-22*f* thereof are connected effectively in series with second loop 12, with each battery being shunted by an associated one of bypass capacitors 24*a*-24*f*. Another bypass capacitance 26 may be utilized to connect second loop ends 12*a* and 12*b*, such that, when loop end 12*a* is connected to a ground potential point 28, the entire loop 12 is at ground potential for the information transceiver and proximity detection frequencies. From a D.C. viewpoint, the functional unit batteries 22 are series-connected between loop ends 12*a* and 12*b*, and therefore between control unit terminals 14*c* and 14*d*. A battery charging means 30, forming part of control unit 14, has the positive output terminal 30*a* thereof connected, through control unit terminal 14*c*, to first end 12*a* of the second loop, which loop end is connected to the most-positive terminal of the series-connected batteries 22 to be charged. The most-negative loop end 12*b* is connected, through control unit terminal 14*d*, to the remaining battery charging means terminal 30*b*. The equivalent voltage of means 30 (represented by a battery 32) is adjusted, as necessary, for proper charging of the plurality of series-connected functional unit batteries 22, when a charging means enabling switch 34 is closed. In this manner, all of functional units 20 receive charging current, whereby failure of operation due to battery-discharge conditions is alleviated.

The information communications function utilizes a data transceiver means 40, as part of control unit 14.

Transceiver means 40 has a data input 40*a*, for receiving data, of voice and/or digital format, from suitable ancillary equipment (not shown) and has a data output 40*b* for providing received data to the ancillary equipment. The transceiver is connected to one winding 42*a* of a transformer means 42, having a center-tapped secondary winding 42*b*. Opposite ends 42*b*-1 and 42*b*-2 of the transformer secondary winding are connected through control unit terminals 14*a* and 14*b* to respective first loop ends 11*a* and 11*b*. The secondary winding center tap 42*b*-3 is maintained at D.C. ground potential, whereby entire loop 11 is safely maintained at D.C. ground potential. The data transceiver output waveform is thus coupled to first loop 11, inducing a magnetic field in the vacinity thereof. Thus, magnetic field components $M_1$ and $M_2$ are induced by current flow through loop 11, on opposite sides of the loop. It will be seen that, within the loop periphery, the directions are such that the magnetic field components are additive, with respect to a pickup loop 50, forming part of a portable interior communications means 52. It will also be seen that beyond the first loop periphery, the magnetic components from opposite portions of the loop tend to cancel one another, reducing the magnitude of coupling to portable units beyond the loop periphery, e.g. in adjacent buildings and the like. Thus, a portable communications means 54, including the portable loop 50 and a portable transceiver means 52, can receive data transmitted from central control unit transceiver means 40, and can transmit data back to the central transceiver means 40 by inductive coupling to first loop 11. Illustratively, voice information has been transmitted by utilizing an audio amplifier, of approximately 20 watts power output, coupled to a first loop 11 comprising a single turn of number 22 insulated wire mounted about the periphery of a building. First loop 11 had a resistance on the order of 3 ohms and an inductance on the order of 120 microhenries. Portable unit 52 included an antenna coil 50 formed of about 500 turns of number 22 enameled wire on an insulative form of about $2\frac{1}{2}$ inches in diameter and about $2\frac{1}{2}$ inches in length, with a resistance on the order of 6 ohms and an inductance on the order of 14 millihenries. Portable unit 52 signal strengths on the order of 40 millivolts, peak-to-peak, were provided by portable pickup coil 50 to portable transceiver 54. A maximum signal of less than 20 millivolts was measured at a distance of 30 feet from the building, with worse case signal amplitude in a neighboring building being measured at least 20 db. below the signal magnitude within the loop periphery. Further, easily recognizable voice communications were received with only headphones attached to loop 50, within the periphery of first loop 11.

The proximity detection function utilizes an oscillator comprised of an operational amplifier 55, having the inverting -input 55*a* thereof connected to ground potential point 28. The non-inverting +input 55*b* the operational amplifier is connected to transformer secondary winding center tap 42*b*-3, which is itself connected to ground potential via an oscillator coil 57. A coil tap 57*a* is connected to the operational amplifier output 55*c*, which is also connected to a frequency counter means 59, forming a portion of proximity detector means 60, itself known to the art. A capacitance 62 is formed between the first and second loops 11 and 12, which capacitance appears in parallel with the inductance of coil 57. The gain of amplifier 55 and the placement of inductive coil tap 57*a* are adjusted such that an oscillatory waveform appears at amplifier output 55*c*, with a frequency determined by the inductance of coil 57 and the capacitance 62 between the first and second loops. The frequency of the amplifier output oscillatory waveform is established to be outside the band of frequencies utilized for intra-building communications (i.e. to be different than the frequencies utilized by information transceiver means 40). The oscillation frequency is substantially continuously counted by counter means 59 and compared against a reference count, in proximity detector means 60. Under normal, non-intrusive circumstances, the oscillator frequency will be substantially equal to the predetermined reference frequency, whereby proximity detector means 60 disables a proximity alarm output 60*a*. In the event that an intrusion occurs, the proximity of the intruder to the periphery loops changes the magnitude of capacitance 62 therebetween and, therefore, the oscillation frequency. The oscillator output count in counter 59 changes and is no longer substantially equal to the preset count, whereby proximity detector means 60 activates the alarm output 60*a* thereof, in control unit 14, to cause commencement of such intrusion-detected action as is required for building security.

It should be understood that each of the functional units 20, which need only be wired to the second peripheral loop 12 and need not be adjacent to a power outlet, can each also be equipped with a communications unit 52, which may include either a transmitter, receiver or transceiver 54 in conjunction with a loop antenna 50, whereby any functional unit so equipped can signal an appropriate alarm by inductive coupling to first loop 11 and thence through transformer 42 and transceiver 40 to provide building alarm daata at transceiver output 40*b*. Thus, a complete building security, communications and control system can be provided in an existing building by the addition of the first and second loops 11 and 12, without the necessity of adding additional power line wiring and the resultant interference thereof, yet while providing continuous functional-unit battery-charging capability to further increase the reliability of the entire system.

While one presently preferred embodiment of my novel building security, communication and control system is described in detail herein, many modifications and variations will not become apparent to those skilled in the art. It is my intent, therefore, to be limited only by the scope of the appending claims, and not by the specific details provided by the way of description herein.

what is claimed is:

1. A system for providing perimeter security, intra-building communication and power to powering means in each of at least one functional unit in a building, comprising:

first and second conductive loops placed about the building periphery and spaced from one another;

means coupled to said first and second loops for detecting an intruder in proximity to said building periphery;

data transceiver means coupled to a first one of said loops for transmitting data to, and for receiving data from, the interior of said building by magnetic induction; and means for providing power to those of said functional unit powering means connected in series with said second loop.

2. The system of claim 1, wherein said detecting means operates at a predetermined frequency, and further comprising means for bypassing each of said functional unit powering means, connected in said second loop, at at least said frequency of operation of said detecting means.

3. The system of claim 1, wherein said proximity detecting means includes: an amplifier; an inductance element coupled between said first and second loops and to said amplifier and having a value to cause oscillations to occur at said frequency and determined by said inductance value and the value of a capacitance between said first and second loops; and means for detecting a change in oscillation frequency to indicate the presence of an intruder adjacent to said building periphery.

4. The system of claim 3, wherein said frequency change detecting means includes a frequency counter.

5. The apparatus of claim 1, wherein said data transceiver means has an input receiving data to be transmitted, a first output providing recovered received data and a carrier input/output; and a transformer for coupling the transceiver carrier input/output to said first loop.

6. The system of claim 5, wherein said transformer has a tapped secondary winding; said secondary winding tap being connected to said proximity detecting means.

7. The system of claim 1, wherein said second loop is maintained substantially at D.C. ground potential.

8. The system of claim 1, wherein each of powering means includes a rechargeable battery, and said power providing means includes means for charging a rechargeable battery.

9. The system of claim 8, wherein a plurality of said powering means batteries are connected in series, and said charging means has a variable output potential.

10. The system of claim 1, wherein at least one of said at least one functional unit is in communication, via said first loop, with said data transceiver means.

* * * * *